US012655983B2

(12) United States Patent
Wang

(10) Patent No.: US 12,655,983 B2
(45) Date of Patent: Jun. 16, 2026

(54) UNPOWERED SMOKELESS STOVE

(71) Applicant: XIAMEN ECOTOP INDUSTRIAL CO., LTD., Xiamen (CN)

(72) Inventor: Hongbin Wang, Xiamen (CN)

(73) Assignee: Fujian Ecotop New Material Co., Ltd., Zhangzhou (CN)

( * ) Notice: Subject to any disclaimer, the term of this patent is extended or adjusted under 35 U.S.C. 154(b) by 478 days.

(21) Appl. No.: 18/353,906

(22) Filed: Jul. 18, 2023

(65) Prior Publication Data

US 2025/0027651 A1 Jan. 23, 2025

(51) Int. Cl.
*F24B 1/19* (2006.01)

(52) U.S. Cl.
CPC ..... *F24B 1/19* (2013.01)

(58) Field of Classification Search
CPC ..... A47J 37/0763; A47J 33/00; F24B 1/19
USPC .... 126/43, 25 R, 26, 77; 431/320, 195, 201, 431/326, 328
See application file for complete search history.

(56) References Cited

U.S. PATENT DOCUMENTS 4,909,235 A * 3/1990 Boetcker ..... A47J 37/0704 126/25 C
12,127,708 B2 * 10/2024 Ahmed ..... F24B 1/207
2017/0347832 A1 * 12/2017 Lin ..... F24B 13/00

* cited by examiner

*Primary Examiner* — Vivek K Shirsat
(74) *Attorney, Agent, or Firm* — Zhigang Ma

(57) ABSTRACT

An unpowered smokeless stove is provided, and includes a housing, an inner barrel, and a top ring, the inner barrel is placed on the housing by means of the top ring; the inner barrel comprising an outer wall and a thermal insulation layer, the outer wall comprising an outer layer and a inner layer, a side of the inner layer being provided with combustion holes and air inlet holes, the thermal insulation layer includes a first thermal insulation layer, a second thermal insulation layer, a third thermal insulation layer, and a fourth thermal insulation layer, a first being arrange between the inner layer and the outer layer, a second gap being arranged between the first thermal insulation layer and a second thermal insulation layer, the air inlet holes are arranged between the first thermal insulation layer and the second thermal insulation layer.

19 Claims, 3 Drawing Sheets

UNPOWERED SMOKELESS STOVE

TECHNICAL FIELD

The disclosure relates to a combustion device, in particular to an unpowered smokeless stove.

BACKGROUND

As a novel, environment-friendly, and energy-saving heating mode, conventional smokeless stoves are often powered by energy such as gas or wood for heating. However, these stoves have problems such as severe heat loss, insufficient combustion, and generation of a large amount of exhaust gas and smoke. Meanwhile, these stoves, which are connected to external power supplies or supported by other energy, are inconvenient and unsafe to use. Moreover, insulation designs of existing stoves are not perfect enough, so that low utilization of heat and large temperature fluctuations result in uncomfortable use.

For example, the applicant previously disclosed a stove in patent CN218721668U on Mar. 24, 2023, which includes a combustion stove and a housing, where the combustion stove includes an inner stove body, an outer stove body, and a bottom plate. A single oxygen supply passage of the stove results in insufficient or excessive oxygen, so that combustion is insufficient and a lot of exhaust gas and smoke are still discharged. Meanwhile, the temperature of a conventional stove easily affects an external environment and has large fluctuations, so the conventional stove is uncomfortable for people in use. Therefore, it is necessary to redesign existing stoves.

SUMMARY

The disclosure provides a unpowered smokeless stove, It is designed to solve the problems of waste gas and smoke emission, low energy efficiency, large temperature fluctuation and inconvenient use of the existing technology. The invention aims to improve energy utilization efficiency and reduce energy waste, conforms to the national policy of energy conservation and environmental protection, and has a wide market application prospect.

An unpowered smokeless stove includes a housing, an inner barrel, and a top ring, the inner barrel is placed on the housing by means of the top ring; the inner barrel comprising an outer wall and a thermal insulation layer, the outer wall comprising an outer layer and a inner layer, a side of the inner layer being provided with combustion holes and air inlet holes, the thermal insulation layer includes a first thermal insulation layer, a second thermal insulation layer, a third thermal insulation layer, and a fourth thermal insulation layer, a first being arrange between the inner layer and the outer layer, a second gap being arranged between the first thermal insulation layer and a second thermal insulation layer, the air inlet holes are arranged between the first thermal insulation layer and the second thermal insulation layer.

The inner layer is fixed inside the outer layer by an connector, a portion of the inner layer protrudes from the outer layer, and the air inlet holes are arranged at a periphery of the portion, protruding from the outer layer, of the inner layer, the air inlet holes are elongated kidney-shape holes evenly arranged at a periphery of the side of the inner layer.

The combustion holes first combustion holes 136 and second combustion holes, and the first combustion holes and the second combustion holes are annularly arranged at an upper part and a middle part of the inner layer separately.

The first thermal insulation layer, the second thermal insulation layer, the third thermal insulation layer, and the fourth thermal insulation layer are all metallic thermal insulation layer, and an air thermal insulation layer is formed between the first thermal insulation layer and the second thermal insulation layer.

Elongated kidney-shape holes are evenly arranged on the first thermal insulation layer.

The third thermal insulation layer is made of a non-metallic inorganic material. The unpowered smokeless stove of claim 1, the housing is made of ceramic fibers.

A first spacing slot and a second spacing slot are arranged at a top and bottom of the housing separately.

The top ring is provided with ventilation holes, a fire gathering ring is detached or fixed on the top ring.

comprises a fifth thermal insulation layer, the fifth thermal insulation layer is a thermal insulation pad, the thermal insulation pad is located at a bottom of the housing. and made of a fiberglass fabric material plated with aluminum on two sides.

Beneficial effects of the present invention are as follows:

1. The double-wall thermal insulation design reduces heat loss and improves utilization efficiency of heat, thereby achieving purposes of fuel saving, energy conservation, and consumption reduction.
2. The double oxygen supply passages are designed, and air passes through the first gap and the second gap to fully supply oxygen required for combustion, so that combustion is more sufficient and stable to effectively reduce the generation of smoke.
3. The thermal insulation layer arranged at the bottom of the inner barrel further reduces an impact of an external environment on temperature and ensures stability and consistency of the temperature in the stove.
4. The unpowered combustion mode does not require power or other energy, and has no unbearable adverse factors such as noise and vibration, so the stove is safe, reliable, and easy to use.

The above descriptions are merely preferred embodiments of the present invention and are not intended to limit the present invention. Any modifications, equivalent substitutions, and improvements made within the spirit and principle of the present invention should fall within the protection scope of the present invention.

BRIEF DESCRIPTION OF THE DRAWINGS

In order to illustrate the technical solution in the embodiments of the disclosure or the prior art more clearly, a brief description of drawings required in the embodiments or the prior art is given below. Obviously, the drawings described below are only some of the embodiments of the disclosure. For ordinary technicians in this field, other drawings can be obtained according to the structures shown in these drawings without any creative effort.

DETAILED DESCRIPTION OF THE EMBODIMENTS

Figure 1:
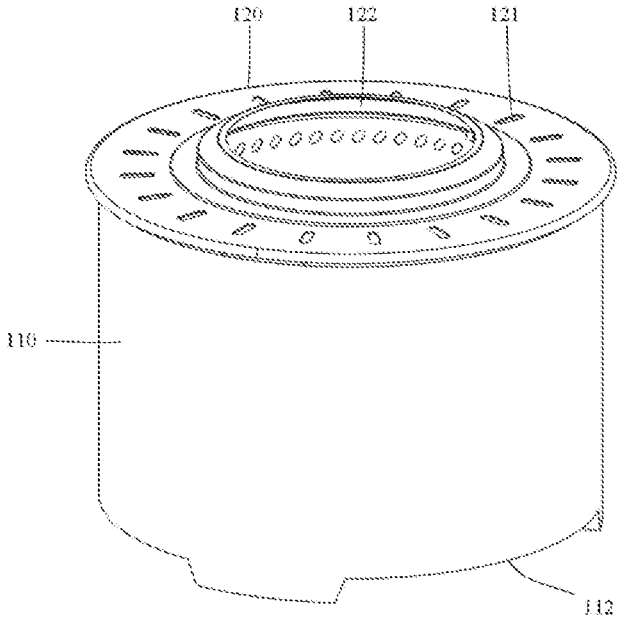
FIG. 1 is a schematic structural diagram of an unpowered smokeless stove of the present invention.

In order to make objectives, technical solutions and advantages of the embodiments of the present invention clearer, the technical solutions of the embodiments of the present invention will be described clearly and completely below with reference to the accompanying drawings in the embodiments of the present invention.

FIGS. 1-5 show an unpowered smokeless stove of the present invention. The unpowered smokeless stove includes a housing 110, an inner barrel 130, and a top ring 120. The inner barrel 130 is placed on the housing 110 by means of the top ring 120, the inner barrel 130 includes an outer wall 131 and a thermal insulation layer, the outer wall 131 includes an inner layer 132 and an outer layer 133, and a side of the inner layer 132 is provided with combustion holes and air inlet holes 135. The thermal insulation layer is located at a bottom of the inner layer 132, and includes a first thermal insulation layer 141, a second thermal insulation layer 142, a third thermal insulation layer 143, and a fourth thermal insulation layer 144. Elongated kidney-shape holes are evenly arranged on the first thermal insulation layer 141, and the first thermal insulation layer 141 has a planar structure, which increases space inside the stove, ensures that a fuel in each area of the stove is evenly and fully burned, and enables outside air to enter into the first thermal insulation layer 141 more easily to improve a ventilation effect, so as to accelerate air circulation and increase oxygen supply. In this case, combustion is more sufficient, and exhaust emissions are reduced, thereby reducing generation of smoke and reducing pollution to an environment. Meanwhile, heat can be released more quickly from the interior of the first thermal insulation layer 141, thereby reducing a temperature and pressure at which the first thermal insulation layer 141 is heated. As a result, the first thermal insulation layer 141 can be protected from bending or deformation at a high temperature, stability of the unpowered smokeless stove is improved, and a service life of the unpowered smokeless stove is prolonged.

Figure 2:
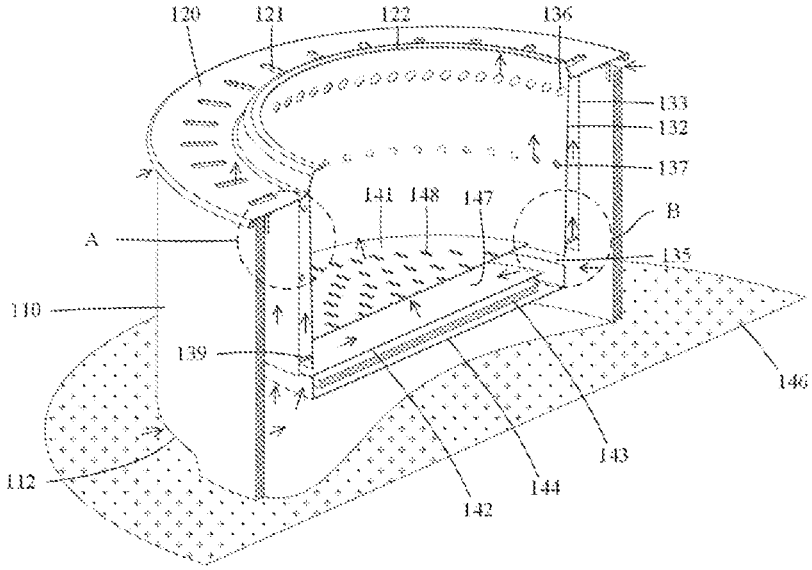
FIG. 2 is a cross-sectional view of FIG. 1, where small arrows represent flow directions of air.
Figure 5:
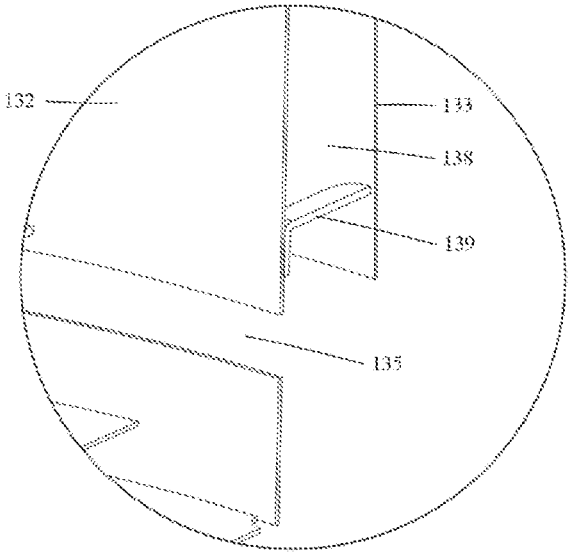
FIG. 5 is an enlarged schematic diagram of Part B in FIG. 2

With reference to FIG. 2 and FIG. 5, the outer layer 133 is fixedly connected to the top ring 120, and the inner layer 132 is fixed inside the outer layer 133 by means of a connector 139. A first gap 138 is arranged between the inner layer 132 and the outer layer 133, a second gap 147 is arranged between the first thermal insulation layer 141 and the second thermal insulation layer 142, and the air inlet holes 135 are arranged between the first thermal insulation layer 141 and the second thermal insulation layer 142. Air enters the inner barrel 130 through the first gap 138 and the second gap 147 separately to form double oxygen supply passages and fully supply oxygen required for combustion, so that the combustion is more sufficient and stable to effectively reduce the generation of smoke.

The first thermal insulation layer 141, the second thermal insulation layer 142, and the fourth thermal insulation layer 144 are all metallic thermal insulation layers, and an air thermal insulation layer is formed between the first thermal insulation layer 141 and the second thermal insulation layer 142. Therefore, a degree of heat transferred from a bottom of the inner barrel 130 to a ground can be reduced, the heat received by the ground can be reduced, and an anti-scalding ground can be achieved accordingly.

The third thermal insulation layer 143 is made of a non-metallic inorganic material, and is located in an accommodating cavity formed by the second thermal insulation layer 142, the fourth thermal insulation layer 144, and the inner layer 132. A combination of the metallic thermal insulation layers and the inorganic thermal insulation layer can prevent heat transfer and reduce energy dissipation, thereby improving thermal insulation performance and reducing an impact on an external environment.

A fifth thermal insulation layer 145 is a thermal insulation pad 146. The thermal insulation pad 146 is located at a bottom of the housing 110 and made of a fiberglass fabric material plated with aluminum on two sides, which has a good thermal insulation effect and further prevents heat from diffusing downwards. The stove is provided with 5 thermal insulation layers from top to bottom, which can avoid damage to a floor and protect a vulnerable surface of a lawn, a wooden floor, or the like. Meanwhile, the stove can also increase a reversibility of upward heat dissipation, thereby achieving purposes of energy conservation and environmental protection.

With reference to FIG. 2, a portion of the inner layer 132 protrudes from the outer layer 133, and the air inlet holes 135 are arranged at a periphery of the portion, protruding from the outer layer 133, of the inner layer 132. The air inlet holes 135 are elongated kidney-shape holes evenly arranged at a periphery of the side of the inner layer 132. The outer layer 133 does not block the air inlet holes 135, and air can flow smoothly into the second gap 147 to ensure sufficient oxygen supply.

The combustion holes include first combustion holes 136 and second combustion holes 137, and the first combustion holes 136 and the second combustion holes 137 are annularly arranged at an upper part and a middle part of the inner layer 132 separately. When a height of a fuel in the inner barrel 130 exceeds that of the second combustion holes 137, the fuel is fully burned at the first combustion holes 136, and when the height of the fuel is lower than that of the second combustion holes 137, the fuel is fully burned at the second combustion holes 137. The inner barrel 130 is provided with the combustion holes in an upper row and a lower row, so that the fuel can be fully burned in each process, and ventilation and air circulation are also improved.

Figure 3:
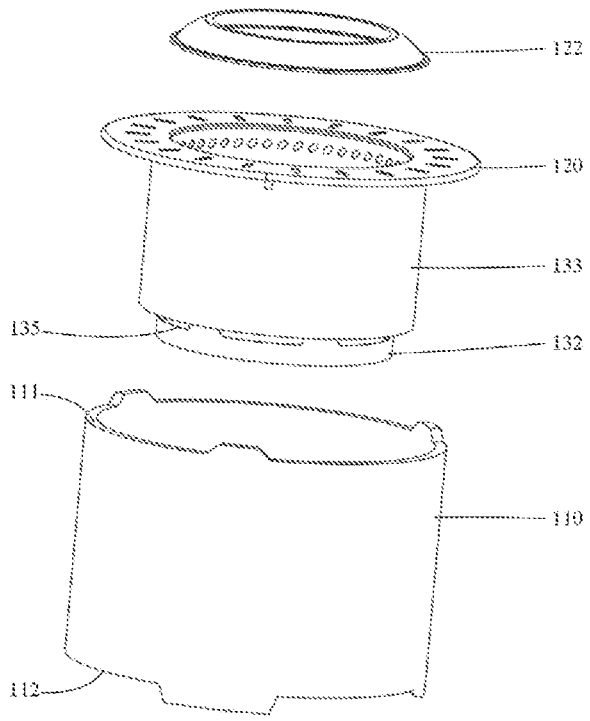
FIG. 3 is an exploded schematic diagram of FIG. 1.

With reference to FIG. 2 and FIG. 3, the housing 110 is made of ceramic fibers, and a first spacing slot 111 and a second spacing slot 112 are arranged at a top and bottom of the housing 110 separately. The top ring 120 is provided with ventilation holes 121. Air enters the housing 110 through the first spacing slot 111 and the second spacing slot 112 separately, and is discharged through the ventilation holes 121 to take away the heat on the top ring 120, so as to prevent the top ring 120 from deformation due to excessive heating temperature.

In addition, the housing 110, the outer layer 133, and the inner layer 132 form three lateral thermal insulation layers to avoid the transfer of heat generated by high-temperature combustion to the outside, so as to ensure normal operation of the stove and improve utilization of heat energy. It is the housing 110 made of an inorganic thermal-insulation and fireproof material that plays a crucial role, with a maximum temperature rise of about 80° C. in a combustion process (in a combustion process of a conventional all-metal stove, a surface temperature of a side wall may reach 250° C.), so that a consumer will not be scalded when touching the housing during use.

Figure 4:
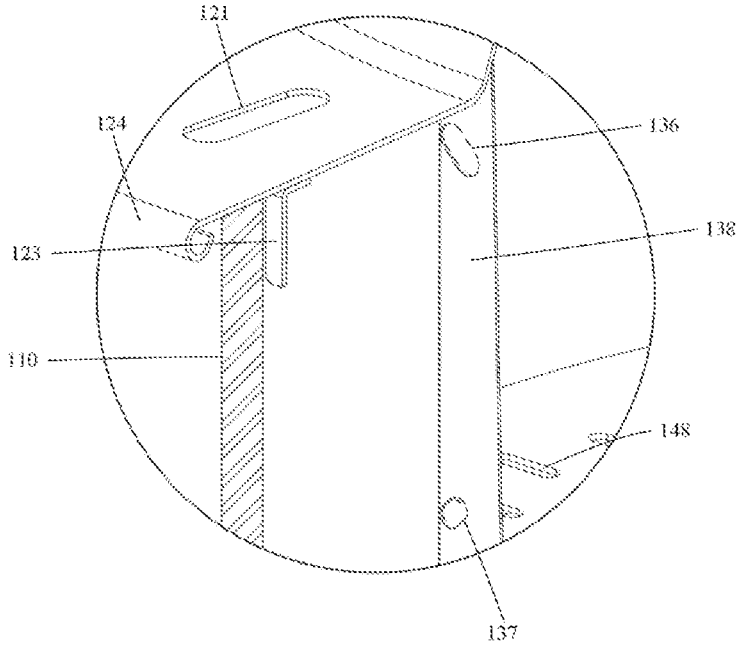
FIG. 4 is an enlarged schematic diagram of Part A in FIG. 2.

With reference to FIG. 2 and FIG. 4, a positioning member 123 is arranged at a bottom of the top ring 120, an edge cover 124 is arranged at a periphery of the top ring 120, the positioning member 123 and the edge cover 124 form a circular limit groove, and the housing 110 is located inside the circular limit groove.

The top ring 120 and a fire gathering ring form an integrated structure, which can increase the strength of the top ring 120 to avoid high-temperature deformation, and especially avoid the influence of wind on flames during outdoor use.

It should be noted that the embodiments number of this disclosure above is for description only and do not represent the advantages or disadvantages of embodiments. And in this disclosure, the term "including", "include" or any other variants is intended to cover a non-exclusive contain. So that the process, the devices, the items, or the methods includes a series of elements not only include those elements, but also include other elements not clearly listed, or also include the inherent elements of this process, devices, items, or methods. In the absence of further limitations, the elements limited by the sentence "including a . . . " do not preclude the existence of other similar elements in the process, devices, items, or methods that include the elements.

The above are only the preferred embodiments of this disclosure and do not therefore limit the patent scope of this disclosure. And equivalent structure or equivalent process transformation made by the specification and the drawings of this disclosure, either directly or indirectly applied in other related technical fields, shall be similarly included in the patent protection scope of this disclosure.

The invention claimed is:

1. An unpowered smokeless stove, comprising a housing, an inner barrel, and a top ring, the inner barrel is placed on the housing by means of the top ring; the inner barrel comprising an outer wall and a thermal insulation layer, the outer wall comprising an outer layer and an inner layer, a side of the inner layer being provided with combustion holes and air inlet holes, the thermal insulation layer includes a first thermal insulation layer, a second thermal insulation layer, a third thermal insulation layer, and a fourth thermal insulation layer, a first gap being arranged between the inner layer and the outer layer, a second gap being arranged between the first thermal insulation layer and the second thermal insulation layer, the air inlet holes are arranged between the first thermal insulation layer and the second thermal insulation layer, wherein the inner layer is fixed inside the outer layer by a connector, a portion of the inner layer protrudes from the outer layer, and the air inlet holes are arranged at a periphery of the portion, protruding from the outer layer, of the inner layer, the air inlet holes are elongated kidney-shape holes evenly arranged at a periphery of the side of the inner layer.

2. The unpowered smokeless stove of claim 1, wherein the combustion holes include first combustion holes and second combustion holes, and the first combustion holes and the second combustion holes are annularly arranged at an upper part and a middle part of the inner layer separately.

3. The unpowered smokeless stove of claim 1, wherein the first thermal insulation layer, the second thermal insulation layer, the third thermal insulation layer, and the fourth thermal insulation layer are all metallic thermal insulation layers, and an air thermal insulation layer is formed between the first thermal insulation layer and the second thermal insulation layer.

4. The unpowered smokeless stove of claim 1, wherein elongated kidney-shape holes are evenly arranged on the first thermal insulation layer.

5. The unpowered smokeless stove of claim 1, wherein the third thermal insulation layer is made of a non-metallic inorganic material.

6. The unpowered smokeless stove of claim 1, wherein the housing is made of ceramic fibers.

7. The unpowered smokeless stove of claim 1, wherein a first spacing slot and a second spacing slot are arranged at a top and bottom of the housing separately.

8. The unpowered smokeless stove of claim 7, wherein the top ring is provided with ventilation holes, a fire gathering ring is detached or fixed on the top ring.

9. The unpowered smokeless stove of claim 1, further comprising a fifth thermal insulation layer, the fifth thermal insulation layer is a thermal insulation pad, the thermal insulation pad is located at a bottom of the housing, and made of a fiberglass fabric material plated with aluminum on two sides.

10. An unpowered smokeless stove, comprising a housing, an inner barrel, and a top ring, the inner barrel is placed on the housing by means of the top ring; the inner barrel comprising an outer wall and a thermal insulation layer, the outer wall comprising an outer layer and an inner layer, a side of the inner layer being provided with combustion holes and air inlet holes, the thermal insulation layer includes a first thermal insulation layer, a second thermal insulation layer, a third thermal insulation layer, and a fourth thermal insulation layer, a first gap being arranged between the inner layer and the outer layer, a second gap being arranged between the first thermal insulation layer and the second thermal insulation layer, the air inlet holes are arranged between the first thermal insulation layer and the second thermal insulation layer;

wherein the combustion holes include first combustion holes and second combustion holes, and the first combustion holes and the second combustion holes are annularly arranged at an upper part and a middle part of the inner layer respectively.

11. The unpowered smokeless stove of claim 10, wherein the first thermal insulation layer, the second thermal insulation layer, the third thermal insulation layer, and the fourth thermal insulation layer are all metallic thermal insulation layers, and an air thermal insulation layer is formed between the first thermal insulation layer and the second thermal insulation layer.

12. The unpowered smokeless stove of claim 10, wherein elongated kidney-shape holes are evenly arranged on the first thermal insulation layer.

13. The unpowered smokeless stove of claim 10, wherein the third thermal insulation layer is made of a non-metallic inorganic material.

14. The unpowered smokeless stove of claim 10, wherein the housing is made of ceramic fibers.

15. The unpowered smokeless stove of claim 10, further comprising a fifth thermal insulation layer, the fifth thermal insulation layer is a thermal insulation pad, the thermal insulation pad is located at a bottom of the housing, and made of a fiberglass fabric material plated with aluminum on two sides.

16. An unpowered smokeless stove, comprising a housing, an inner barrel, and a top ring, the inner barrel is placed on the housing by means of the top ring; the inner barrel comprising an outer wall and a thermal insulation layer, the outer wall comprising an outer layer and an inner layer, a side of the inner layer being provided with combustion holes and air inlet holes, the thermal insulation layer includes a first thermal insulation layer, a second thermal insulation layer, a third thermal insulation layer, and a fourth thermal insulation layer, a first gap being arranged between the inner layer and the outer layer, a second gap being arranged between the first thermal insulation layer and the second thermal insulation layer, the air inlet holes are arranged between the first thermal insulation layer and the second thermal insulation layer; wherein a first spacing slot and a second spacing slot are disposed at a top and bottom of the housing respectively, the top ring forms ventilation holes, the air enters the housing through the first spacing groove and the second spacing groove respectively, and is discharged through the ventilation holes.

17. The unpowered smokeless stove of claim 16, wherein the first thermal insulation layer, the second thermal insulation layer, the third thermal insulation layer, and the fourth thermal insulation layer are all metallic thermal insulation layers, and an air thermal insulation layer is formed between the first thermal insulation layer and the second thermal insulation layer.

18. The unpowered smokeless stove of claim 16, wherein elongated kidney-shape holes are evenly arranged on the first thermal insulation layer.

19. The unpowered smokeless stove of claim 16, wherein the third thermal insulation layer is made of a non-metallic inorganic material.

* * * * *